United States Patent [19]

Ruigrok

[11] Patent Number: 4,637,186

[45] Date of Patent: Jan. 20, 1987

[54] FENCE POLE

[75] Inventor: Franciscus B. M. Ruigrok, Son, Netherlands

[73] Assignee: Heras Holding, B.V., Oivschot, Netherlands

[21] Appl. No.: 716,597

[22] Filed: Mar. 27, 1985

Related U.S. Application Data

[63] Continuation of Ser. No. 440,718, Nov. 10, 1982, abandoned.

[30] Foreign Application Priority Data

Nov. 11, 1981 [NL] Netherlands ..... 8105107

[51] Int. Cl.[4] ..... E04C 3/26; E04H 17/14

[52] U.S. Cl. ..... 52/225; 52/723; 256/19; 256/66

[58] Field of Search ..... 256/19, 32, 66, 73; 52/224, 170, 722, 723, 225, 226

[56] References Cited

U.S. PATENT DOCUMENTS

| | | | |
|---|---|---|---|
| 110,221 | 12/1870 | Filson | 256/19 |
| 277,493 | 5/1883 | Likes et al. | 52/722 |
| 429,547 | 6/1890 | Rogers | 52/170 |
| 552,268 | 12/1895 | Wood | 52/223 R |
| 650,299 | 5/1900 | Broussas | 52/722 |
| 709,735 | 9/1902 | Blee et al. | 52/223 R |
| 758,178 | 4/1904 | Hedrick | 52/225 |
| 760,111 | 5/1904 | Ewell . | |
| 784,420 | 3/1905 | Oliver | 256/66 |
| 816,171 | 3/1906 | Inarra | 52/722 |
| 869,724 | 10/1907 | Nichols | 52/722 |
| 919,772 | 4/1909 | Roberts | 52/722 |
| 937,794 | 10/1909 | Haas | 52/223 R |
| 966,274 | 8/1910 | Wainwright et al. | 52/722 |
| 973,670 | 10/1910 | Kinnear | 52/223 R |
| 1,084,727 | 1/1914 | Camden | 52/722 |
| 1,107,248 | 2/1912 | Clay | 256/73 |
| 1,153,560 | 9/1915 | Miller | 256/73 |
| 1,322,802 | 11/1919 | McPhail | 52/722 |
| 1,339,819 | 5/1920 | Gresham | 52/722 |
| 1,508,950 | 9/1924 | Angeli | 52/170 |
| 1,676,679 | 7/1928 | Bensinger | 52/722 |
| 2,075,633 | 3/1937 | Anderegg | 52/722 |
| 2,176,530 | 10/1939 | Greulich | 52/170 |
| 2,803,868 | 8/1957 | Dobell . | |
| 2,825,796 | 3/1958 | Lanmon | 256/32 |
| 3,110,368 | 11/1963 | Ross | 52/225 |
| 3,940,114 | 2/1976 | Rivelli | 256/32 |
| 4,033,080 | 7/1977 | Fukushima | 52/223 R |

FOREIGN PATENT DOCUMENTS

| | | | |
|---|---|---|---|
| 258351 | 4/1965 | Australia | 52/722 |
| 8102438 | 9/1981 | European Pat. Off. | 52/722 |
| 1214887 | 4/1966 | Fed. Rep. of Germany | 52/722 |
| 653402 | 3/1929 | France | 52/722 |
| 2309694 | 11/1976 | France . | |
| 547756 | 9/1956 | Italy | 52/224 |
| 43154 | 11/1958 | Poland | 52/722 |
| 257001 | 8/1927 | United Kingdom | 52/722 |
| 698424 | 10/1953 | United Kingdom | 52/722 |

*Primary Examiner*—Carl D. Friedman
*Assistant Examiner*—Michael Safavi
*Attorney, Agent, or Firm*—John P. Snyder

[57] ABSTRACT

A pole for use in a fence, railing or the like, the pole body (1) being made from a curable material such as concrete, whilst pairs of opposite tensioning elements (10) are arranged along the outer sides (7) of the pole body (1) and between anchoring parts at the head (11) and the foot (12) of said pole, each of said side faces having a groove (8) for accomodating said tensioning elements (10), whereas said faces are tapered starting from a given cross-section A—A. Each groove locally may have depended transverse notches (23) for fastening a trelliswork.

18 Claims, 14 Drawing Figures

Figure 1:
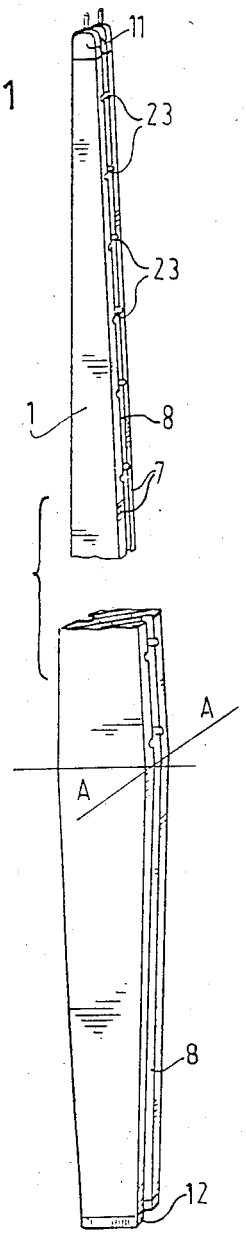

FIG.10
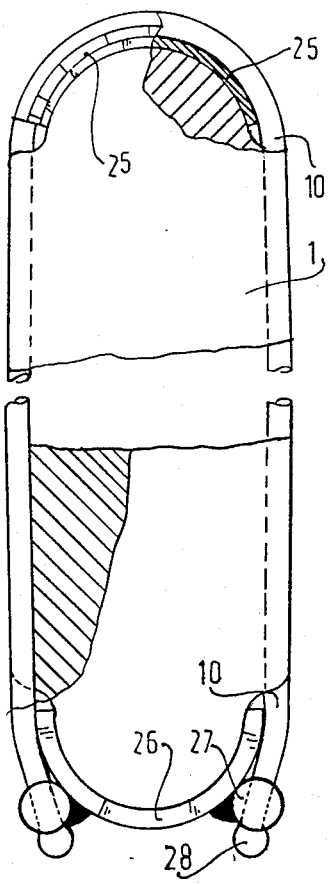
FIG.11
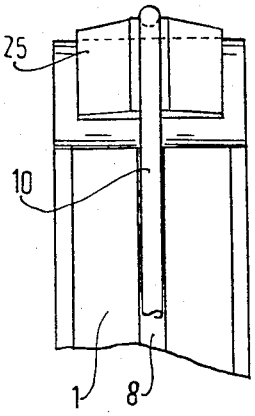
FIG.14
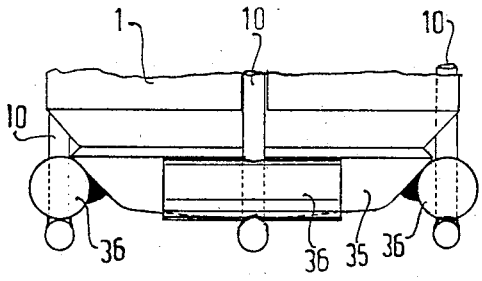
FIG. 12
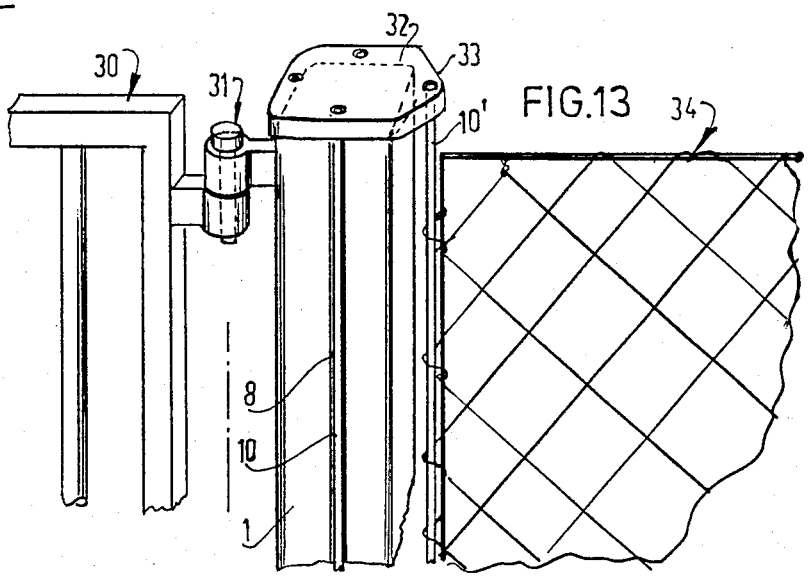
FIG.13

FENCE POLE

This application is a continuation of application Ser. No. 440,718, filed Nov. 10, 1982, now abandoned.

The invention relates to a pole for use in a fence, railing or the like, the pole body being made from a curable material such as concrete, whilst a reinforcement is arranged between anchoring parts at the head and the foot of said pole.

The invention has for its object to improve a pole of the kind set forth in the preamble in a manner such that its weight can be appreciably reduced so that the maniability is enhanced and the insertion of the pole into the ground is facilitated. The invention has furthermore for its object to simplify and accelerate the manufacture of the pole so that the cost price is reduced.

The pole according to the invention is distinguished in that by way of reinforcement two tensioning elements arranged opposite one another with respect to the cross-section of the pole are provided along the outer sides of each pole body.

The arrangement of the tensioning elements on the outer side has the advantage that the pole body can be manufactured without reinforcement, which enables the manufacture of a pole body in a compression mould capable of resisting high pressures. By arranging the reinforcement afterwards, that is to say, after the pole body has cured, and by trimming the tightening effect, the pole can have less weight and, moreover, be made much more rapidly, since curing can take place without heating. Since the tensioning elements are external of the pole, the pole is, moreover, reinforced to the optimum against potential bending forces.

In order to provide sufficient guiding of each tensioning element throughout its length and to embellish the appearance of the pole, each tensioning element is arranged, in accordance with the invention, in a groove provided in one side of the pole.

In a preferred embodiment the distance between two opposite grooved sides decreases both towards the head and the foot, starting from a given cross-section. This enhances the aesthetic appearance of the pole, whilst owing to the tapering foot the stability of the pole is enhanced when it is keyed tight in a previously made hole in the ground.

Preferably said given cross-section is located at ground level so that a simple indication is obtained for the depth to which the pole has to be fixed in the ground.

In order to facilitate the arrangement of grids or gauze on the pole, each groove locally has deepened transverse notches, through which can be passed the tie means for the trelliswork so that they look behind the tensioning elements.

The invention furthermore relates to a method of manufacturing a pole of the kind set forth in the preamble, said method being distinguished in that a curable mixture is charged in a compression mould, the mixture is densified in the mould by pressure, anchoring pieces are arranged at head and foot after curing and finally two elements located opposite one another with respect to the cross-section of each pole are tightened by means of the anchoring pieces.

The invention will be described more fully with reference to the drawing, which shows a few embodiments.

Figure 2:
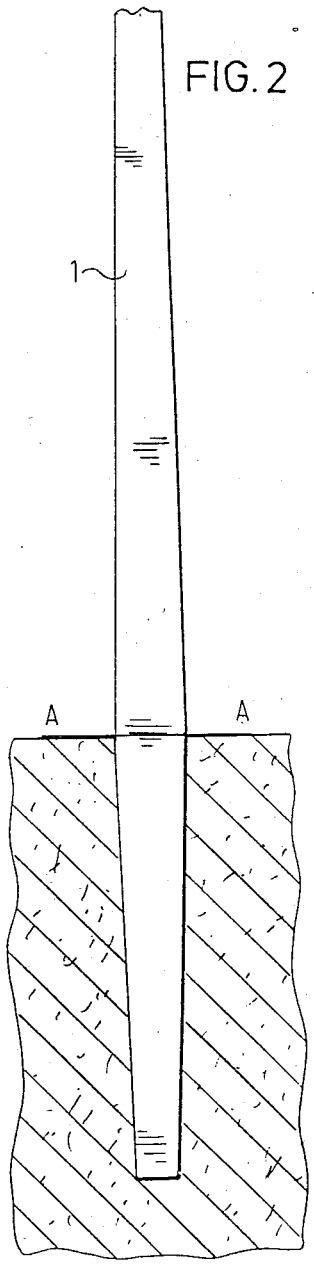
Figure 3:
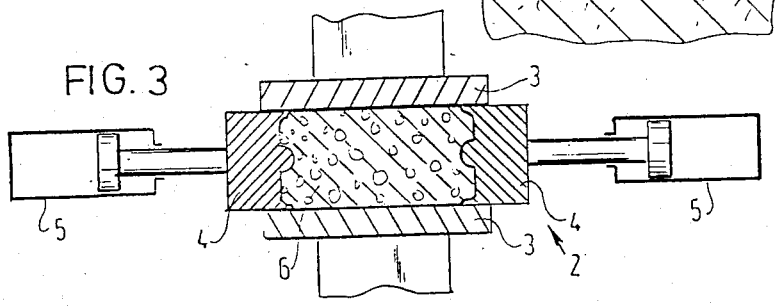
Figure 4:
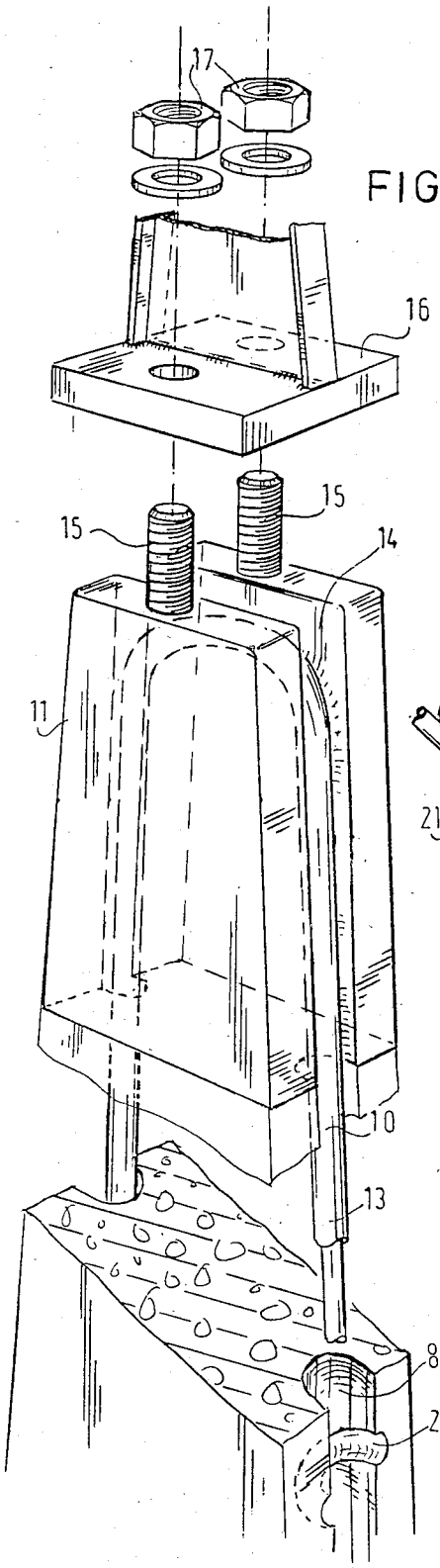
Figure 5:
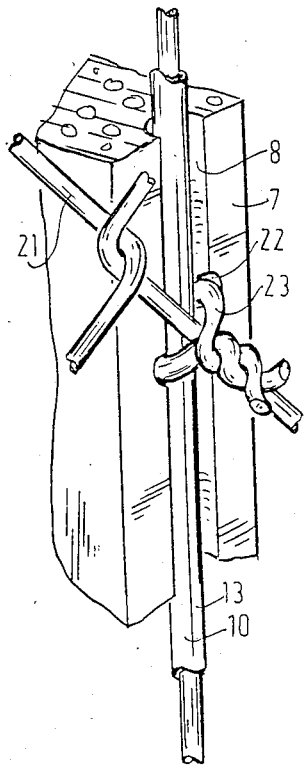
Figure 6:
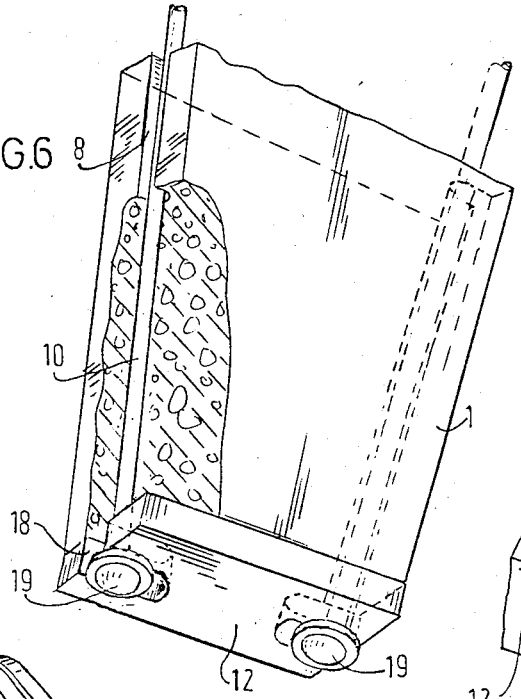
Figure 7:
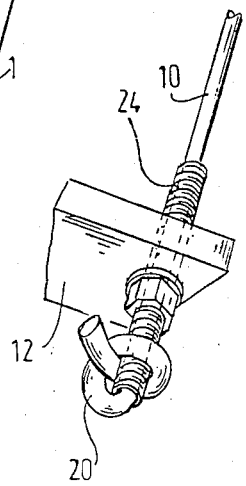
Figure 9:
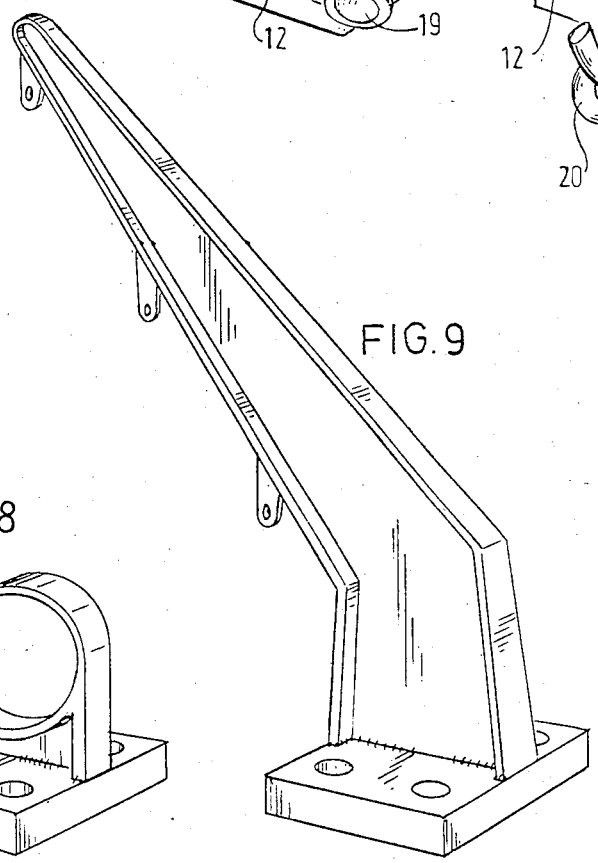
Figure 8:
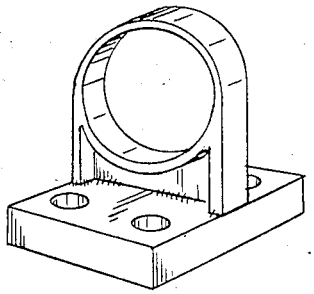

FIG. 1 is a perspective view of a pole body in accordance with the invention, FIG. 2 shows the lower part of a pole inserted into the ground, FIG. 3 is a horizontal cross-sectional view of a schematic representation of a compression mould, FIG. 4 shows a detail of the anchoring member at the pole head, FIG. 5 shows a detail of the tensioning element in a groove of the pole, FIG. 6 shows a detail of the lower anchoring element at the pole foot, FIG. 7 shows an alternative design for tightening the tensioning element, FIGS. 8 and 9 show two perspective views of potential extension pieces for the pole embodying the invention, FIGS. 10 and 11 show a front and side view of an alternative embodiment of the upper anchoring member, FIG. 12 shows a front view of an alternative embodiment of the lower anchoring element, FIG. 13 shows a perspective view of a pole provided woth two pairs of tensioning elements, FIG. 14 shows an anchoring member corresponding with FIG. 12, for four tensioning elements.

The pole body 1 shown in the Figures is made from a curable material such as concrete so that it can be manufactured in a compression mould 2 schematically shown in FIG. 3.

The mould 2 mainly comprises two sheet walls 3 covering the whole length of the pole to be made. Between the sheets 3 movable profile walls 4 are slidable and also cover the whole length of the pole. In the embodiment shown the two profile walls can be moved towards and away from one another by means of cylinders, but within the scope of the invention one profile wall 4 may be stationary with respect to the side walls 3. After the curable mixture 6 is charged in the mould, the cylinders 5 can be energized so that the mixture 6 is compressed by high pressure. The compressed product can subsequently cure outside the mould. This process can be carried out without the supply of heat so that energy consumption and hence the cost price are reduced.

The profile walls 4 are designed so that in two opposite sides 7 of the pole a longitudinal groove 8 is formed for guiding a tensioning element to be described more fully hereinafter.

The shape of the profile walls 4 is such that away from a given cross-section A—A (see FIGS. 1 and 2) the sides 7 converge both towards the head and foot of the pole body.

Therefore, the distance between said sides gradually decreasses upwards and downwards. The said cross-section A—A corresponds, in fact, to the ground level when the pole is inserted into the ground (see FIG. 2). Thus the appearance of the pole having a svelt structure is enhanced, whilst in addition mounting the pole is facilitated because the foot can be keyed in a hole made in the ground.

As stated above, a tensioning element 10 is arranged in the grooves 8 and anchored in an anchoring element 11 and 12 respectively on the head and below the foot of the pole.

The tensioning element 10 is preferably formed by a bar or wire having a coating 13 protecting the wire against the weather conditions. The coating 13 may be a synthetic resin envelope, but it may as well be made of any other material, for example, a weather-resistant paint.

The upper anchoring element 11 (see FIG. 4) is formed by a moulded, tapering piece of solid material, the outer periphery of which matches the outer periphery at the head of the pole 1. The element 11 also has a circumferential groove 14 matching the groove 8 in the sides of the pole. The circumferential groove extends from one side to the other in the anchoring element 11 so that in this embodiment a tensioning element 10 prolonged on the top side can be used. However, the head may be designed in any different way and it may have, for example, a seat for holding a thickened head of the tensioning element 10.

The head piece may be provided with fastening means, for example, two tapped ends 15 with the associated nuts 17 so that an auxiliary piece 16 can be fixed. The auxiliary piece may have any desired form and it is shown in a perspective view in FIGS. 8 and 9.

On the underside the pole has the anchoring element 12 (see FIG. 6) consisting of a flat plate, the circumference of which matches the circumference at the pole foot. The plate has recesses 18 accomodating the ends of the tensioning elements 10. The elements 10 are prestressed on a bench and the knobs 19 previously jumped up on the wire hook behind the anchoring element 12. In this way the cured pole body can be reinfoced in the disired manner by means of the tensioning element.

FIG. 7 shows an embodiment of a tensioning element 10 formed by a flexibly cable which can be fastened by means of a toggle knot 20 in the tensioning element 24.

FIG. 5 Illustrates a mode of fastening a trellis or gauze 21 to the tensioning element 10. For this purpose the groove 8 in the side 7 of the pole locally has deepened transverse channels 22 so that a fastening wire can be passed behind the tensioning element 10, after which the ends of the fastening element 23 can be twisted tightly around a wire of the trellis 21. Preferably the transverse channels 22 are at an angle differing from 90° to the groove 8 so that the fastening element 23 can be readily passed around the inclined wires 21 of the trellis. Preferably the transverse channels 22 are provided at equal intervals one above the other in the groove (see FIG. 1).

FIGS. 10 and 11 are showing an alternative embodiment of the upper anchoring member. It is here formed by a bended plate member 25, provided with a channel located centrally in the upper surface. The channel will correspond with the location of the longitudinal groove 8 in the pole body 1. So adapted to accomodate the tensioning element 10. In this embodiment the top of the body 1 is curved and recessed with respect to the side faces of the pole body 1.

FIG. 12 shows an alternative anchoring element 26 at the foot of the pole. This plate-like anchoring element 26 is again bended around a curved lower surface of the foot, which is also recessed. The tensioning elements 10 are led through a hole of an anchoring member 27, whereas the end of the element 10 is provided with a knob 28, corresponding to the knob 19 in FIG. 6. To tighten the elements 10 it is necessary to clamp the anchoring member 27 unto the anchoring element 26 and to weld these together under clamping conditions.

FIG. 13 shows a pole in the embodiment of an end pole of a trelliswork. To this end-pole a swing gate 30 can be mounted by means of a hinge 31. The fastening of the hinge 31 to the pole can be done in any suitable manner and falls outside the scope of the invention. The pole body may be in the form of the previous embodiments according to FIG. 1. At the top of the pole body 1 an anchoring plate 32 is mounted, which plate extends over one side of the pole, see at 33. The remaining circumference of the plate 32 corresponds to the contour of the top surface of the pole 1. In the plate 32 holes are provided for taking up the top end of a clamping member 10. Said clamping members may be provided with knobs like 19, falling in a recess in the upper surface of plate 32. Three of the tensioning members 10 are accomodated in longitudinal grooves 8 in the three side surfaces of the pole body 1. The fourth tensioning member 10' is taken up in a hole of the part 33 of the plate 32, in order to have the tensioning member at a distance of the pole body 1. Owing to this structure it is possible to take up the weight of the swing gate 30 without needing a bigger pole body 1. Preferably the trelliswork 34 can be fastened to the outstanding tensioning member 10'.

FIG. 14 shows a lower anchoring element 35, to which anchoring members 36 corresponding to those 27 in FIG. 12 are welded. Here the anchoring element 35 is cup-like and fits over the foot of the pole body 1 and having a substantially rectangular form. To the oblique side surfaces of the cup-like anchoring element the anchoring members 36 can be clamped, whereupon welding can take place under clamping conditions, so obtaining the prescribed tensioning force in the elements 10 and 10'.

The invention is not limited to the embodiments described above.

What is claimed is:

1. A fence post construction comprising an elongate body of cured concrete, said body having opposite side faces, said body being double tapered so that the width thereof between the opposite side faces increases from one end of the body to an intermediate portion thereof and then decreases to an end opposite said one end of the body, a first rigid end member engaged against said one end of the body and a second rigid end member engaged against the opposite end of the body, external tensioning means having one run engaging one of said side faces and another run engaging the other of said side face for holding said end members against the respective ends of the body and securing means holding said tensioning means in tensioned condition for placing the cured concrete of said body under longitudinal compression between said end members and for pressing said runs upon said body to place the cured concrete of said body under transverse compression between said runs.

2. A fence post as defined in claim 1 wherein each side face is provided with a longitudinal groove having a bottom and walls, said runs engaging the bottoms of the respective longitudinal grooves.

3. A fence post as defined in claim 2 wherein said body is made of compressed concrete which has been cured.

4. A fence post as defined in claim 2 wherein said opposite side faces are provided with transverse grooves which are formed in the walls of said longitudinal grooves and extend transversely thereof to receive fastening elements passing beneath said runs.

5. A fence post as defined in claim 4 wherein said transverse grooves are disposed at an acute angle with respect to said longitudinal grooves.

6. A fence post as defined in claim 1 wherein said runs each comprise a metal core and a protective sheath therefor.

7. A fence post as defined in claim 2 wherein said runs each comprise a metal core and a protective sheath therefor.

8. A fence post as defined in claim 5 wherein said runs each comprise a metal core and a protective sheath therefor.

9. A fence post construction as defined in claim 1 wherein said external tensioning means also includes third and fourth runs, said third and fourth runs extending along opposite side faces of said body which are adjacent said one side face and said other side face and being held in tensioned condition by said securing means, said third run being located in outwardly spaced relation with respect to its associated side face of the body.

10. An improved fence post construction which comprises the combination of:

an elongate body of compressed, cured concrete having a first end at one end of the body and a second end at the opposite end of the body, said first end defining a first end surface delineating the transverse extremity of said first end of the body and said second end defining a second end surface delineating the transverse extremity of said second end of the body;

a first metal end member seated on said first end surface;

a second metal end member seated on said second end surface; and tension rod means extending between said first and said second end members externally of said body and interconnecting said first and second end members for tensioning said tension rod means so as to urge said end members together to bear against their respective end surfaces of the body and thereby place and maintain the concrete of said body between said end members under compression after the concrete is cured.

11. An improved fence post construction as defined in claim 10 wherein said first end member engages said first end surface throughout substantially the entire area thereof and said second end member engages said second end surface throughout substantially the entire area thereof.

12. An improved fence post construction as defined in claim 11 wherein said body defines a first side surface extending from said first end surface to said second end surface and a second side surface extending from said first end surface to said second end surface, said first side surface and said second side surface defining opposite side surfaces of the body, said first side surface having a first groove therein extending from said first end surface to said second end surface and defining a generally U-shaped wall having a bottom and opposite side wall portions, said second side surface having a second groove therein extending from said first end surface to said second end surface and defining a generally U-shaped wall having a bottom and opposite side wall portions, said tension rod means comprising a first tension rod portion lying in said first groove and a second tension rod portion lying in said second groove, said first tension rod portion having a free end passing through said first end member and said second tension rod portion having a free end passing through said first end member, said tension rod portions extending from their free ends to said second end member and having a U-shaped portion joining said tension rod portions and passing over said second end member, and means at said free ends of said tension rod portions and bearing against said first end member for maintaining said tension rod means under tension.

13. A fence post construction as defined in claim 10 wherein said tension rod means includes one tension element located in outwardly spaced relation to said body.

14. A fence post construction as defined in claim 13 wherein said tension rod means includes four separate tension elements of which one is said one tension element and said four tension elements are distributed generally uniformly around the body.

15. A fence post construction as defined in claim 11 wherein said tension rod means includes one tension element located in outwardly spaced relation to said body.

16. A fence post construction as defined in claim 15 wherein said tension rod means includes four separate tension elements of which one is said one tension element and said four tension elements are distributed generally uniformly around the body.

17. A fence post construction as defined in claim 12 wherein said tension rod means includes one tension element located in outwardly spaced relation to said body.

18. A fence post construction as defined in claim 17 wherein said tension rod means includes four separate tension elements of which one is said one tension element and said four tension elements are distributed generally uniformly around the body.

* * * * *